US007986891B2

(12) United States Patent
Yamamoto

(10) Patent No.: US 7,986,891 B2
(45) Date of Patent: Jul. 26, 2011

(54) IMAGE FORMING APPARATUS WITH IMAGE DENSITY DETECTION UNIT

(75) Inventor: Susumu Yamamoto, Tokyo (JP)

(73) Assignee: Oki Data Corporation, Tokyo (JP)

( * ) Notice: Subject to any disclaimer, the term of this patent is extended or adjusted under 35 U.S.C. 154(b) by 78 days.

(21) Appl. No.: 12/382,592

(22) Filed: Mar. 19, 2009

(65) Prior Publication Data

US 2009/0297188 A1 Dec. 3, 2009

(30) Foreign Application Priority Data

May 30, 2008 (JP) ..... 2008-142047

(51) Int. Cl.
*G03G 15/00* (2006.01)
*G03G 15/08* (2006.01)

(52) U.S. Cl. ..... 399/49; 399/55

(58) Field of Classification Search ..... 399/55, 399/53, 49

See application file for complete search history.

(56) References Cited

U.S. PATENT DOCUMENTS

| | | | | |
|---|---|---|---|---|
| 2004/0001725 | A1* | 1/2004 | Onishi | 399/55 |
| 2008/0206661 | A1* | 8/2008 | Fujishima et al. | 399/55 X |
| 2008/0226320 | A1* | 9/2008 | Sakata et al. | 399/55 |
| 2009/0041490 | A1* | 2/2009 | Tsunoda | 399/53 |
| 2009/0196639 | A1* | 8/2009 | Ozeki | 399/55 |
| 2009/0202260 | A1* | 8/2009 | Morikuni et al. | 399/55 X |

FOREIGN PATENT DOCUMENTS

| | | | |
|---|---|---|---|
| JP | 09-305014 | | 11/1997 |
| JP | 10-260573 | | 9/1998 |
| JP | 11-109729 | A * | 4/1999 |
| JP | 11-305501 | A * | 11/1999 |
| JP | 2000-056642 | A * | 2/2000 |
| JP | 2004-029681 | A * | 1/2004 |
| JP | 2007-322716 | | 12/2007 |
| JP | 2008-020534 | | 1/2008 |

OTHER PUBLICATIONS

Machine translation of JP 2008-020534 A dated Jul. 29, 2010.*

* cited by examiner

*Primary Examiner* — Sophia S Chen
(74) *Attorney, Agent, or Firm* — Kubotera & Associates, LLC

(57) ABSTRACT

An image forming apparatus includes an image supporting member for forming a developer image; a developing unit for forming a developer layer and forming the developer image on the image supporting member using developer of the developer layer; a developer supplying unit for supplying the developer to the developing unit; an image density detection unit for detecting an image density of the developer image; and a control unit for controlling a voltage applied to the developing unit and the developer supplying unit. The control unit corrects the voltage applied to at least one of the developing unit and the developer supplying unit according to the image density detected with the image density detection unit.

10 Claims, 8 Drawing Sheets

IMAGE FORMING APPARATUS WITH IMAGE DENSITY DETECTION UNIT

BACKGROUND OF THE INVENTION AND RELATED ART STATEMENT

The present invention relates to an image forming apparatus using an electro-photography process for forming and developing a static latent image on an image supporting member.

In a conventional image forming apparatus such as a printer, a facsimile, an electro-photography color recording apparatus, and the likes, a charging film or a charging roller charges a surface of a photosensitive drum. Then, an exposure light source irradiates the surface of the photosensitive drum according to image information, thereby forming a static latent image on the surface of the photosensitive drum. After, a developing roller attaches toner as developer to the static latent image, a transfer device transfers a toner image to a recording medium, and a fixing device fixes the toner image to the recording medium. Toner is supplied from a toner cartridge to the photosensitive drum through a toner supplying roller and the developing roller.

In the conventional image forming apparatus, after the toner supplying roller and the developing roller rotate one rotation, an amount of toner supplied from the toner supplying roller to the photosensitive drum through the developing roller decreases. More specifically, it is possible to develop an image with a proper density on the recording medium over a length corresponding to a sum of a rotational circumferential length of the photosensitive drum while the developing roller rotates one rotation and a rotational circumferential length of the photosensitive drum while the toner supplying roller rotates one rotation. The density of the image to be developed on the recording medium, however, decreases beyond the length.

To this end, Patent Reference has disclosed conventional technology to prevent the density from decreasing. In the conventional technology, after a photosensitive drum rotates over a length corresponding to a sum of a rotational circumferential length of the photosensitive drum while a developing roller rotates one rotation and a rotational circumferential length of the photosensitive drum while a toner supplying roller rotates one rotation, an amount of toner supplied from the toner supplying roller to the photosensitive drum through the developing roller increases. Accordingly, it is possible to prevent a density step from forming in an image to be printed on a recording medium.

Patent Reference: Japan Patent Publication No. 10-260573

In the conventional technology disclosed in Patent Reference, when an image with a high density is printed on the recording medium, even though an amount of toner supplied from the toner supplying roller to the photosensitive drum through the developing roller increases after the photosensitive drum rotates over the length corresponding to the sum of the rotational circumferential length of the photosensitive drum while the developing roller rotates one rotation and the rotational circumferential length of the photosensitive drum while the toner supplying roller rotates one rotation, it is difficult to sufficiently prevent the density step from forming in the image to be printed on the recording medium.

In view of the problems described above, an object of the present invention is to provide an image forming apparatus capable of solving the problems of the conventional image forming apparatus. In the image forming apparatus of the present invention, even when an image with a high density is printed on a recording medium, it is possible to sufficiently prevent a density step from forming in an image to be printed on a recording medium.

Further objects of the invention will be apparent from the following description of the invention.

SUMMARY OF THE INVENTION

In order to attain the objects described above, according to an aspect of the present invention, an image forming apparatus includes an image supporting member for forming a developer image; a developing unit for forming a developer layer and forming the developer image on the image supporting member using developer of the developer layer; a developing power source for applying a developing voltage to the developing unit; a developer supplying unit for supplying the developer to the developing unit; a developer supplying power source for applying a developer supplying voltage to the developer supplying unit; an image density detection unit for detecting an image density of the developer image; and a control unit for controlling the developing power source and the developer supplying power source. The control unit is adopted to correct a voltage difference between the developing voltage and the developer supplying voltage according to the image density detected with the image density detection unit.

In the aspect of the present invention, the developer supplying voltage applied from the developer supplying power source to the developer supplying unit is corrected. Further, the developer supplied from the developer supplying unit to the developing unit is optimized. Accordingly, it is possible to prevent a density step from forming in an image to be printed on a recording medium.

DETAILED DESCRIPTION OF THE PREFERRED EMBODIMENTS

Hereunder, embodiments of the present invention will be described in detail with reference to the accompanying drawings. In the following description, the present invention is applied to a printer as an image forming apparatus, and is not limited thereto.

First Embodiment

Figure 1:
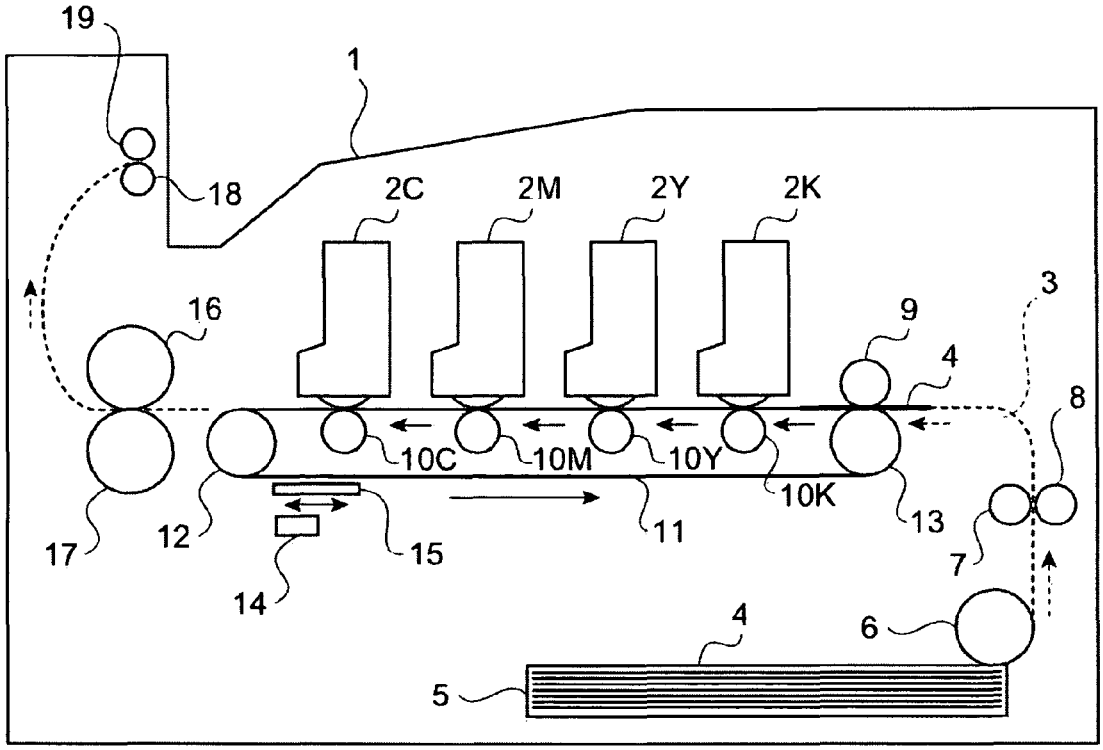
FIG. 1 is a schematic view showing an image forming apparatus according to a first embodiment of the present invention.

A first embodiment of the present invention will be explained. FIG. 1 is a schematic view showing an image forming apparatus 1 according to the first embodiment of the present invention.

As shown in FIG. 1, the image forming apparatus 1 includes image forming units 2C, 2M, 2Y, and 2K for printing on a recording medium 4 according to image information corresponding to colors of cyan, magenta, yellow, and black; and a sheet transport path 3 extending from a sheet cassette 5 as a starting point to a discharge roller 18 and a follower roller 19 for discharging the recording medium 4 with the image information printed thereon as an ending point.

In the image forming apparatus 1, the image forming units 2C, 2M, 2Y, and 2K for printing on the recording medium 4 according to the image information corresponding to colors of cyan, magenta, yellow, and black have an identical configuration. In the following description, the image forming units 2C, 2M, 2Y, and 2K are referred to as an image forming unit 2 (described later).

In the image forming apparatus 1, the sheet transport path 3 extends from the sheet cassette 5 retaining the recording medium 4 as the starting point to the discharge roller 18 and the follower roller 19 as the ending point through a hopping roller 6, a follower roller 7, a register roller 8, an absorbing roller 9, a transfer roller 10, a transfer belt 11, a drive roller 12, an idle roller 13, a density sensor 14, a shutter 15, a heat roller 16, and a backup roller 17. In the following description, the components of the sheet transport path 3 will be explained with reference to FIG. 1.

In the embodiment, the recording medium 4 is a recording sheet having a specific size for developing the image information in monochrome or color. In general, the recording medium 4 includes a recycle sheet, a gloss sheet, a high grade sheet, and an OHP film. The sheet cassette 5 retains a plurality of the recording media 4 for supplying the recording media 4 into the image forming apparatus 1 upon starting a printing operation. Note that the sheet cassette 5 is disposed to be detachable relative to the image forming apparatus 1.

In the embodiment, the hopping roller 6 rotates to supply the recording medium 4 taken out from the sheet cassette 5 one by one to the follower roller 7 and the register roller 8 (described later) in a state that the hopping roller 6 is pressed against the recording medium 4 retained in the sheet cassette 5. The follower roller 7 and the register roller 8 are provided for transporting the recording medium 4 supplied from the hopping roller 6 to the transfer belt 11. The absorbing roller 9 is provided for absorbing the recording medium 4 to the transfer belt 11.

In the embodiment, the transfer roller 10 constitutes a transfer unit for transferring a toner image formed on a surface of a photosensitive drum 22 to the recording medium 4. The transfer roller 10 is disposed at a position facing the photosensitive drum 22 (described later) to be rotatable in a state that the transfer roller 10 sandwiches the recording medium 4 together with the photosensitive drum 22. The transfer roller 10 includes transfer rollers 10C, 10M, 10Y, and 10K corresponding to colors of cyan, magenta, yellow, and black. The transfer rollers 10C, 10M, 10Y, and 10K have an identical configuration, and are collectively referred to as the transfer roller 10. A bias voltage opposite to a voltage supplied to the photosensitive drum 22 is supplied to the transfer roller 10, so that the transfer roller 10 transfers the image information formed on the surface of the photosensitive drum 22 to the recording medium 4. The transfer roller 10 is formed of a foam elastic member.

In the embodiment, the transfer belt 11 is a transport member for transporting the recording medium 4 into the image forming unit 2 to develop the image information. The transfer belt 11 is formed of an endless belt for holding the image information formed of toner 26 on a circumferential surface thereof, and for absorbing the recording medium 4. The drive roller 12 and the idle roller 13 are disposed at both end portions of the transfer belt 11 having an endless shape for applying specific tension to the transfer belt 11. The drive roller 12 and the idle roller 13 are formed of a material having a high frictional resistance. When a drive system (not shown) drives the drive roller 12, the transfer belt 11 follows and rotates.

In the embodiment, the density sensor 14 is an image density detection unit for detecting an image density of a test image printed on the transfer belt 11. More specifically, in the density sensor 14, after a light emitting portion thereof irradiates test light on the transfer belt 11, a light receiving portion thereof receives reflected light, thereby determining a density of a toner image from an amount of reflected light thus received. The light emitting portion of the density sensor 14 is formed of, for example, a light emitting diode, and the light receiving portion is formed of, for example, a silicon photodiode.

In the embodiment, the shutter 15 is disposed between the transfer belt 11 and the density sensor 14, and extends substantially in parallel to the transfer belt 11. When a developing operation is performed in the image forming apparatus 1, the shutter 15 prevents the toner 26 scattering inside the image forming apparatus 1 from attaching to the density sensor 14.

In the embodiment, the heat roller 16 and the backup roller 17 constitute a fixing unit for fixing the toner 26 to the recording medium 4, and are disposed to sandwich the recording medium 4 transported with the transfer belt 11. A heat source (not shown) supplies heat, and the heat roller 16 uses heat to melt the toner 26 on the recording medium 4, thereby fixing the toner 26 to the recording medium 4. When the toner 26 is fixed, the backup roller 17 applies pressure, so that the toner 26 thus melt is fixed to the recording medium 4. After the heat roller 16 and the backup roller 17 fix the toner 26 to the recording medium 4, the discharge roller 18 and the follower roller 19 discharge the recording medium 4 from the image forming apparatus 1.

Figure 2:
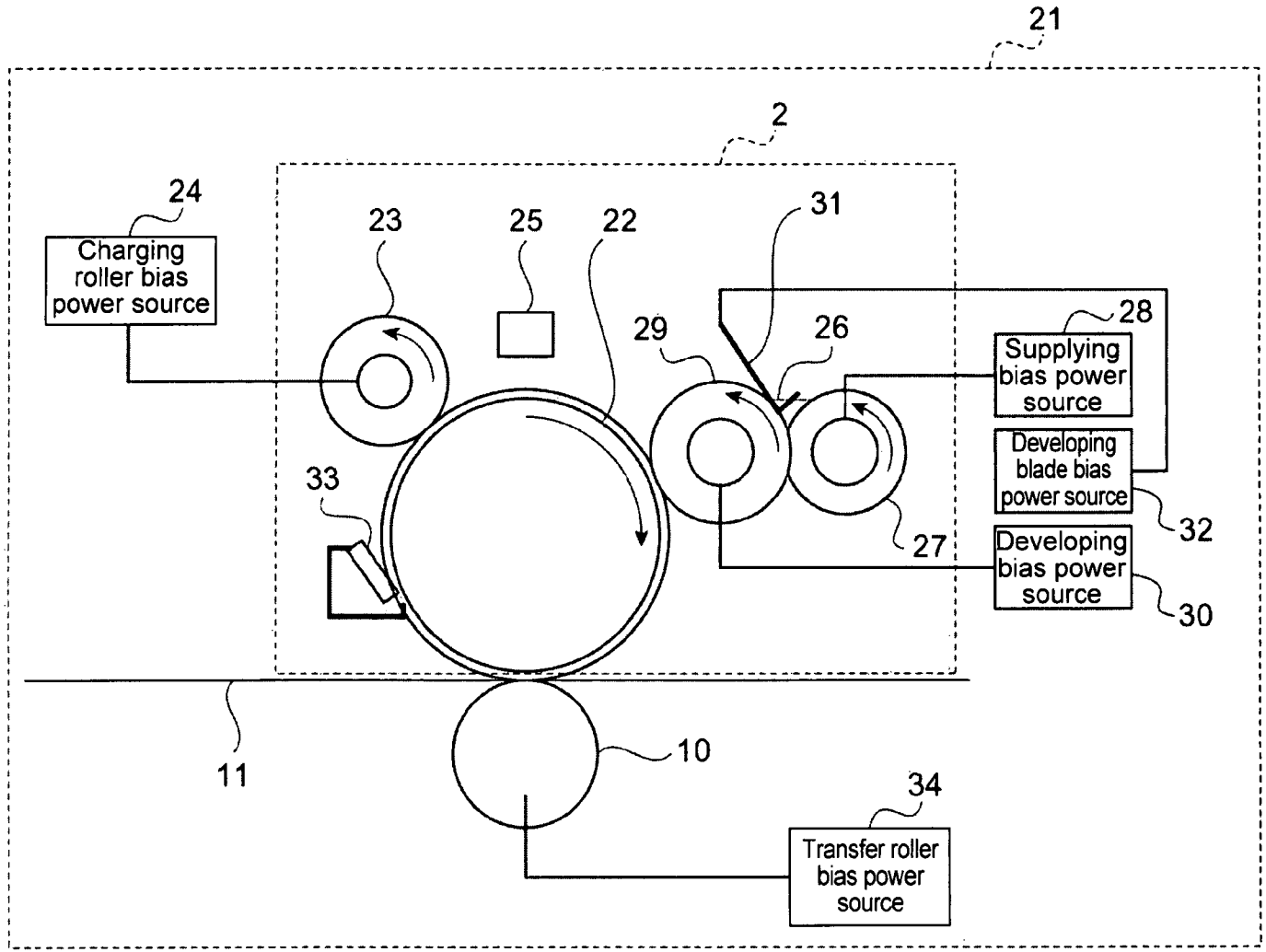
FIG. 2 is a schematic view showing a developing unit of the image forming apparatus according to the first embodiment of the present invention.

A developing unit 21 in the image forming apparatus 1 will be explained next. FIG. 2 is a schematic view showing the developing unit 21 of the image forming apparatus 1 according to the first embodiment of the present invention. As shown in FIG. 2, the developing unit 21 includes the image forming unit 2 for printing on the recording medium 4 according to the image information corresponding to colors of cyan, magenta, yellow, and black; the transfer roller 10; the transfer belt 11; and a power source for supplying power to the components.

The image forming unit 2 will be explained first. The image forming unit 2 includes the photosensitive drum 22 for supporting the static latent image according to the image information; a charging roller 23 for accumulating electron charges on the surface of the photosensitive drum 22; an LED exposure portion 25 for irradiating light on the surface of the photosensitive drum 22 according to the image information; the toner 26 as developer; a toner supplying roller 27 for supplying the toner 26; a developing roller 29 for developing the static latent image using the toner 26; a developing blade 31 for regulating a thickness of the toner 26 at a uniform level;

and a cleaning device 33 for scraping off the toner 26 remaining on the photosensitive drum 22. The LED exposure portion 25 may be disposed on a main body of the image forming apparatus 1.

In the embodiment, the photosensitive drum 22 is an image supporting member for forming a developer image, and is configured to be capable of accumulating electron charges on the surface thereof for supporting the static latent image according to the image information. The photosensitive drum 22 is formed in a cylindrical shape, and is disposed to be rotatable. The photosensitive drum 22 is formed of a conductive base layer formed of aluminum and the likes, and a photosensitive layer formed of an optical conductive layer and an electron charge transport layer.

In the embodiment, the charging roller 23 applies a specific positive voltage or negative voltage to the surface of the photosensitive drum 22 using a power source (not shown), so that electron charges are uniformly accumulated on the surface of the photosensitive drum 22. The charging roller 23 is disposed to be rotatable while contacting with the surface of the photosensitive drum 22 at a specific pressure. The charging roller 23 is formed of a metal conductive shaft and a semi-conductive rubber such as a silicone rubber coated on the metal conductive shaft.

In the embodiment, the LED exposure portion 25 is configured to irradiate light on the surface of the photosensitive drum 22 corresponding to the image information, so that the static latent image is formed on the surface of the photosensitive drum 22. The LED exposure portion 25 is disposed at a position facing the photosensitive drum 22 on a side of the transfer roller 10 opposite to the photosensitive drum 22. The LED exposure portion 25 is formed of a plurality of LED elements, a lens array, and an LED drive element.

In the embodiment, the toner 26 is developer, and is attached to the static latent image formed on the surface of the photosensitive drum 22, thereby visualizing the image information. The toner supplying roller 27 is a developer supplying unit for supplying the toner 26 to the developing roller 29. The toner supplying roller 27 is disposed to abut against the developing roller 29 while rotating, so that the toner supplying roller 27 supplies the toner 26 to the developing roller 29. The toner supplying roller 27 is formed of a conductive metal shaft and a member such as a silicon rubber member coated on the conductive metal shaft.

In the embodiment, the developing roller 29 is a developing unit for forming a toner layer on the photosensitive drum 22, and is disposed to be rotatable while contacting with the surface of the photosensitive drum 22. The developing roller 29 transports the toner 26 to the photosensitive drum 22 while rotating, so that the static latent image formed on the surface of the photosensitive drum 22 is developed with the toner 26. The developing roller 29 is formed of a conductive metal shaft and a member such as a semi-conductive urethane rubber member coated on the conductive metal shaft.

In the embodiment, the developing blade 31 is disposed such that a distal end portion thereof slightly contacts with a surface of the developing roller 29. The developing blade 31 scrapes off the toner 26 supplied from the toner supplying roller 27 to the surface of the developing roller 29 in an amount exceeding a specific level, so that a thickness of the toner 26 formed on the surface of the developing roller 29 is regulated to be uniform all the time. The developing blade 31 is formed of an elastic plate member such as a stainless plate.

In the embodiment, the cleaning device 33 is formed of a cleaning blade and a collection container. The cleaning blade is formed of a rubber member. The cleaning blade is disposed such that a distal end portion thereof abuts against the surface of the photosensitive drum 22, thereby scraping off the toner 26 remaining on the photosensitive drum 22 after the toner image formed on the photosensitive drum 22 is transferred to the recording medium 4. Note that the cleaning device 33 is disposed below the charging roller 23.

In the embodiment, the power source includes a supplying bias power source 28 as a developer supplying power source; a developing bias power source 30 as a developing power source; a developing blade bias power source 32; a charging roller bias power source 24; and a transfer roller bias power source 34. The supplying bias power source 28 controls a voltage applied to the toner supplying roller 27 for adjusting an amount of the toner 26 supplied from the toner supplying roller 27 to the developing roller 29. The developing bias power source 30 controls a voltage applied to the developing roller 29 for adjusting an amount of the toner 26 supplied from the developing roller 29 to the photosensitive drum 22. The developing blade bias power source 32 controls a voltage applied to the developing blade 31 for adjusting a layer thickness of the toner 26 formed on the surface of the toner supplying roller 27. The charging roller bias power source 24 controls a voltage applied to the charging roller 23 for adjusting a charge amount on the surface of the toner supplying roller 27. The transfer roller bias power source 34 controls a voltage applied to the transfer roller 10 for driving the transfer roller 10.

In the embodiment, a power source control unit 49 connected to a printer control unit 41 (described above) is provided for controlling the power source. As described above, the toner 26 is supplied to the photosensitive drum 22 through the toner supplying roller 27 and the developing roller 29 provided with the developing blade 31. Accordingly, the supplying bias power source 28, the developing bias power source 30, and the developing blade bias power source 32 control the amount of the toner 26 supplied to the photosensitive drum 22.

Figure 3:
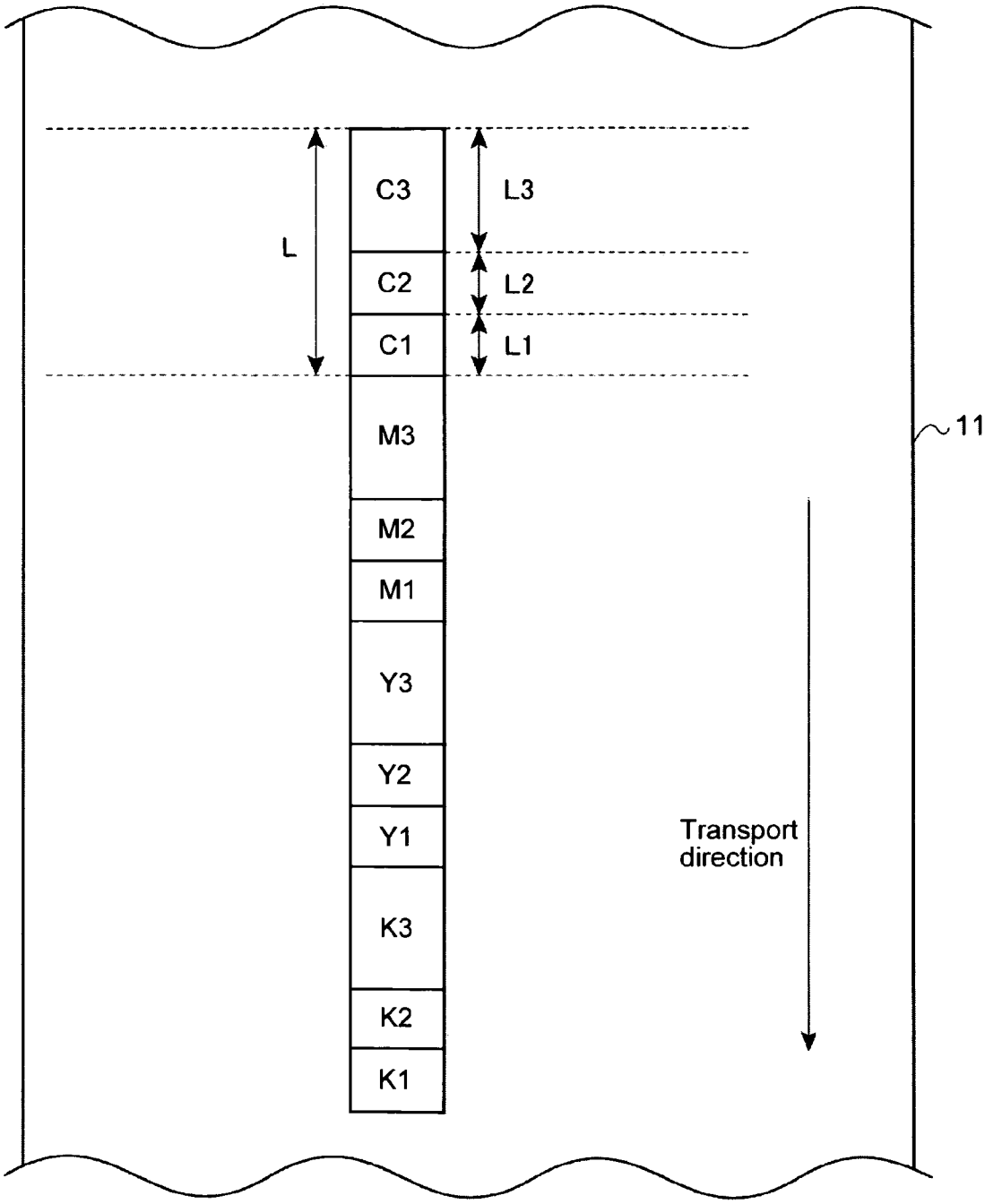
FIG. 3 is a schematic view showing a transfer belt of the developing unit of the image forming apparatus in a state that a patch pattern is formed on the transfer belt according to the first embodiment of the present invention.
Figure 4:
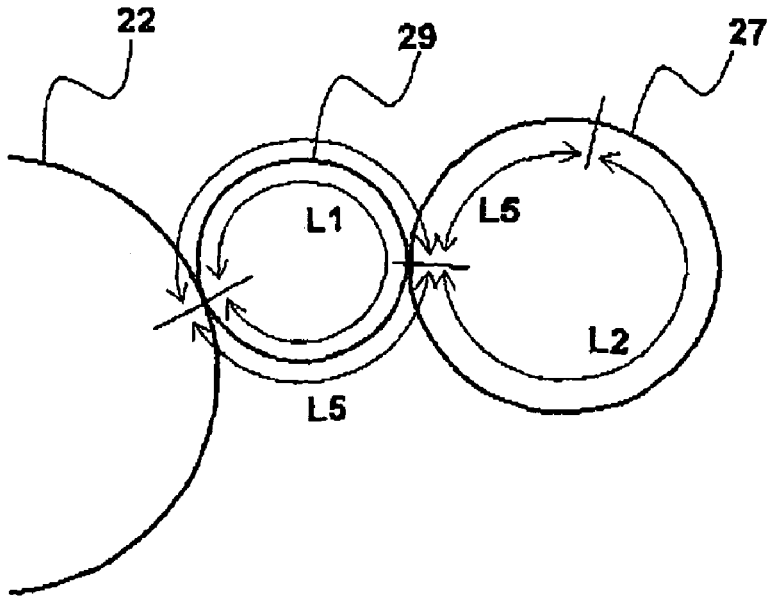
FIG. 4 is an enlarged schematic view showing a portion of the developing unit of the image forming apparatus according to the first embodiment of the present invention.
Figure 4:
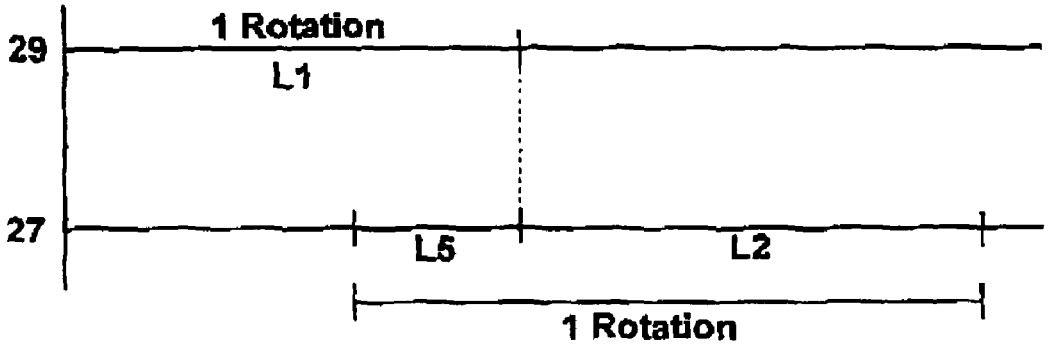

The test image to be printed on the transfer belt 11 for correcting the density will be explained next. FIG. 3 is a schematic view showing the transfer belt 11 of the developing unit 21 of the image forming apparatus 1 in a state that a patch pattern is formed on the transfer belt 11 according to the first embodiment of the present invention. FIG. 4 is an enlarged schematic view showing a portion of the developing unit 21 of the image forming apparatus 1 according to the first embodiment of the present invention. The patch pattern becomes the test image for correcting the density.

As shown in FIG. 3, the patch pattern is the test image having a specific shape with a high density, i.e., a toner density of, for example, 100%. The patch pattern is printed on the transfer belt 11 for adjusting a voltage applied to the toner supplying roller 27 such that a difference between a measured density and a standard density stored in advance is canceled out after the density sensor 14 measures the density. The patch pattern is printed on the transfer belt 11 in an order of, for example, black (K), yellow (Y), magenta (M), and cyan (C).

As shown in FIG. 4, the developing roller 29 has a circumference corresponding to a length L1, and the toner supplying roller 27 has a circumference corresponding to a length L2 and a length L5. In the embodiment, the patch pattern has a print length L equal to a sum of the distance L1 corresponding to the circumferential length of the developing roller 29, the distance L2 corresponding to a part of the circumferential length of the toner supplying roller 27, and a distance L3 after second rotations of the developing roller 29 and the toner supplying roller 27.

Note that the toner supplying roller 27 may have an influence in a length L5 within the length L1, so that it is difficult to clearly define the length L1 and the length L2 as the circumferential lengths of the toner supplying roller 27 and the developing roller 29. Accordingly, the length L2 is defined as one rotation length of the toner supplying roller 27 subtracted by the length L5. In other words, the length L2 is defined as an area where the print density becomes susceptible to an influence of the toner supplying roller 27 in one rotation of the toner supplying roller 27. Note that a maximum value of the print length L corresponds to a length of a printable area for each color in a belt transport direction when the image forming apparatus 1 prints on the recording medium 4 having, for example, an A4 size.

In the embodiment, in the patch pattern of cyan (C), the patch pattern in the length L1 has a density C1, the patch pattern in the length L2 has a density C2, and the patch pattern in the length L3 has a density C3. Similarly, in the patch pattern of black (K), the patch pattern in the length L1 has a density K1, the patch pattern in the length L2 has a density K2, and the patch pattern in the length L3 has a density K3. In the patch pattern of yellow (Y), the patch pattern in the length L1 has a density Y1, the patch pattern in the length L2 has a density Y2, and the patch pattern in the length L3 has a density Y3. In the patch pattern of magenta (M), the patch pattern in the length L1 has a density M1, the patch pattern in the length L2 has a density M2, and the patch pattern in the length L3 has a density M3.

The patch pattern is printed at a position facing the density sensor 14. More specifically, the patch pattern is printed on the transfer belt 11 such that the patch pattern is printed at a position facing the density sensor 14 disposed below the transfer belt 11.

In the embodiment, an amount of the toner 26 supplied to the toner supplying roller 27 increases to prevent an amount of the toner 26 supplied to the photosensitive drum 22 from decreasing. Further, through controlling the developing blade 31 or the developing roller 29, it is possible to prevent an amount of the toner 26 supplied to the photosensitive drum 22 from decreasing.

More specifically, the developing blade bias power source 32 controls a voltage applied to the developing blade 31 according to a bias adjustment table associated with the developing blade 31, so that a layer thickness of the toner 26 formed on the surface of the developing roller 29 increases, thereby preventing an amount of the toner 26 supplied to the photosensitive drum 22 from decreasing. Similarly, the developing bias power source 30 controls a voltage applied to the developing roller 29 according to a bias adjustment table associated with the developing roller 29, so that a layer thickness of the toner 26 formed on the surface of the developing roller 29 increases, thereby preventing an amount of the toner 26 supplied to the photosensitive drum 22 from decreasing.

Figure 5:
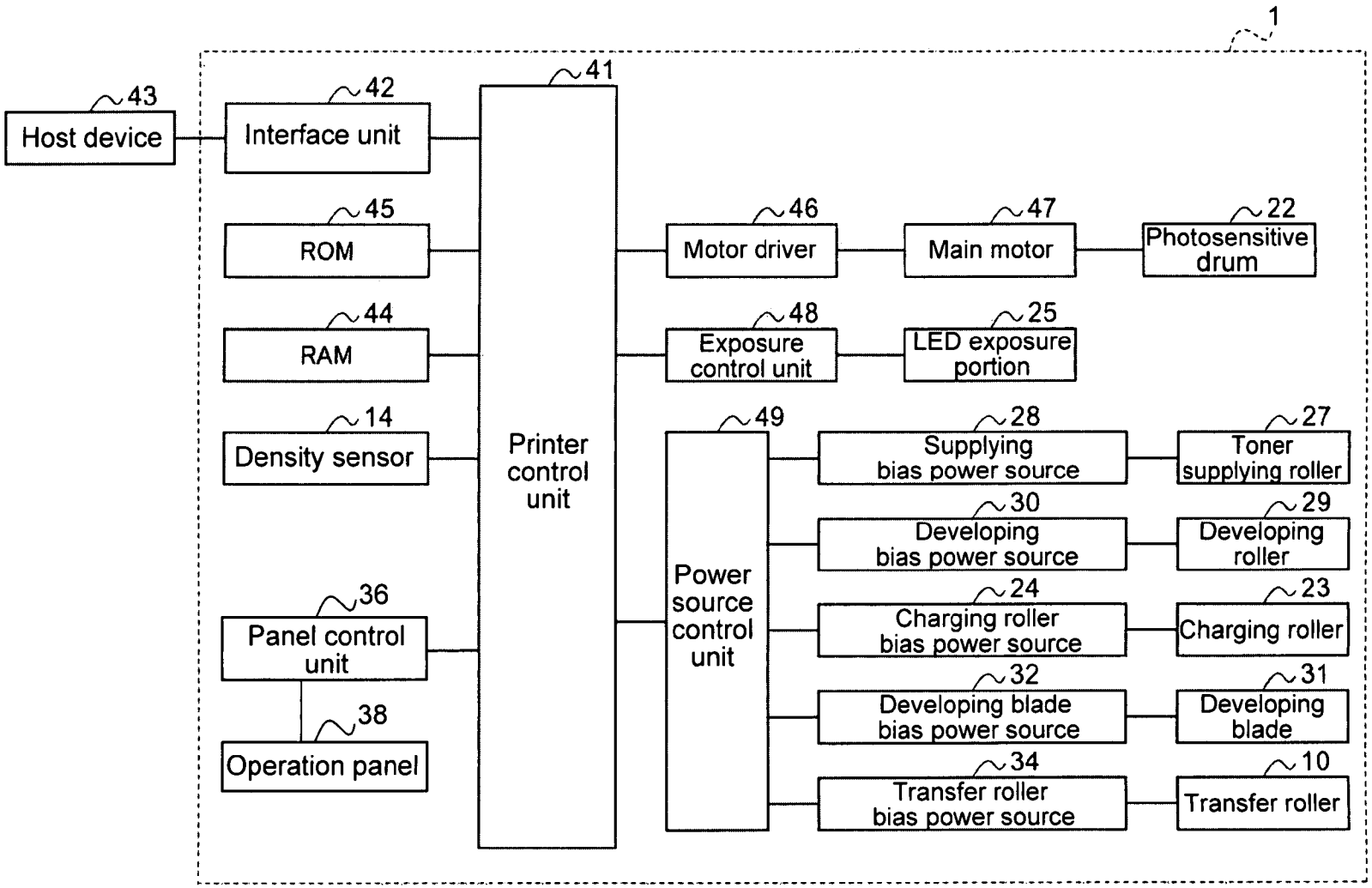
FIG. 5 is a block diagram showing a configuration of the image forming apparatus according to the first embodiment of the present invention.

A control system of the image forming apparatus 1 will be explained next. FIG. 5 is a block diagram showing a configuration of the image forming apparatus 1 according to the first embodiment of the present invention. As shown in FIG. 5, the image forming apparatus 1 is provided with the printer control unit 41 for controlling a process of developing the image information on the recording medium 4.

In the embodiment, the printer control unit 41 is connected to an interface unit 42 for controlling communication of data with respect to a host device 43 such as a personal computer; the density sensor 14 for measuring the toner density of an image developed according to the image information; an RAM 44 for temporarily storing a value of the toner density thus measured; an ROM 45 for storing a table for correcting the toner density and the likes; a motor driver 46 for controlling a main motor 47 for driving the photosensitive drum 22; an exposure control unit 48 for controlling the LED exposure portion 25; a panel control unit 36 for controlling an operation panel 38; and the power source control unit 49 for controlling the charging roller bias power source 24, the supplying bias power source 28, the developing bias power source 30, the developing blade bias power source 32, and the transfer roller bias power source 34.

In the embodiment, the interface unit 42 is a section for controlling communication of data with respect to the host device 43 such as a personal computer according to an instruction from the printer control unit 41. The exposure control unit 48 is provided for controlling the LED exposure portion 25 according to an instruction from the printer control unit 41. The motor driver 46 is a driver for controlling the main motor 47 for driving the photosensitive drum 22 according to an instruction from the printer control unit 41.

Further, according to an instruction from the printer control unit 41, the power source control unit 49 is provided for controlling the charging roller bias power source 24 for supplying power to the charging roller 23, the supplying bias power source 28 for supplying power to the toner supplying roller 27, the developing bias power source 30 for supplying power to the developing roller 29, the developing blade bias power source 32 for supplying power to the developing blade 31, and the transfer roller bias power source 34 for supplying power to the transfer roller 10. Note that the supplying bias power source 28, the developing bias power source 30, and the developing blade bias power source 32 control an amount of the toner 26 supplied to the photosensitive drum 22.

In the embodiment, the RAM 44 is a rewritable non-volatile memory for temporarily storing the value of the toner density measured with the density sensor 14. According to an instruction from the printer control unit 41, the value of the toner density is stored to or retrieved from the RAM 44. The ROM 45 is a rewritable non-volatile memory for storing the table for correcting the toner density and the likes. According to an instruction from the printer control unit 41, a supplying bias correction table or a density correction patch pattern stored in the ROM 45 is retrieved.

In the embodiment, the panel control unit 36 is provided as an image quality mode selection unit for controlling the operation panel 38. The operation panel 38 includes a plurality of switches and lamps, and is disposed on the image forming apparatus 1, so that an operator can perform a specific setting to the image forming apparatus 1. The panel control unit 36 retains a setting value, and controls contents displayed on the operation panel 38. For example, when the operation panel 38 displays an apparatus menu and the operator selects a high density printing operation, the panel control unit 36 retains a setting value of the high density printing operation. It may be configured such that the printer control unit 41 performs the density correction when the high density printing operation is selected.

Figure 6:
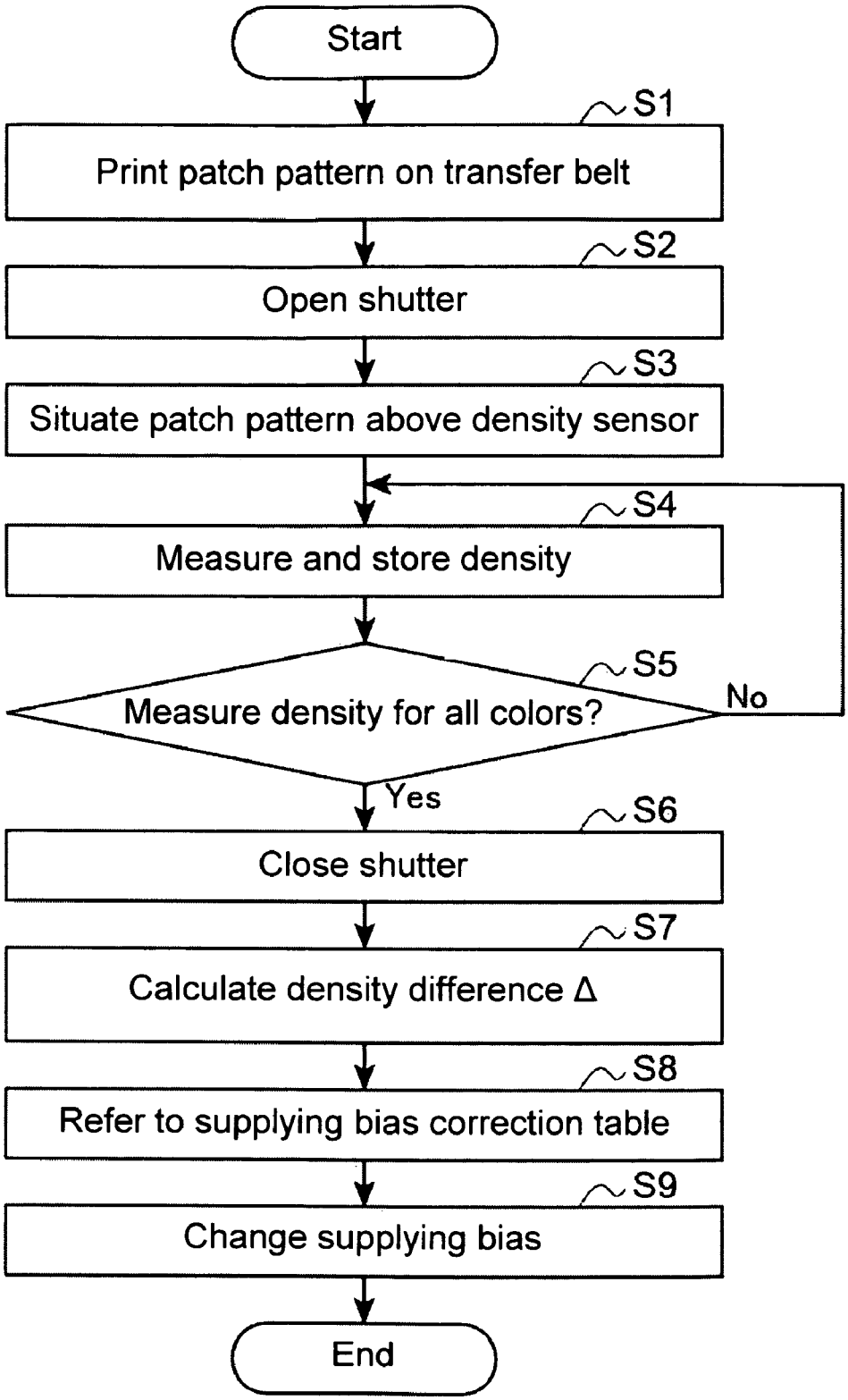
FIG. 6 is a flow chart showing an operation of the image forming apparatus for preventing a density step from forming in an image according to the first embodiment of the present invention.

An operation of the image forming apparatus 1 associated with the toner density correction for preventing a density step from forming in an image developed on the recording medium 4 will be explained next. FIG. 6 is a flow chart showing the operation of the image forming apparatus 1 associated with the toner density correction for preventing a density step from forming in an image according to the first embodiment of the present invention.

In step S1, when the printer control unit 41 detects that the operator turns on the image forming apparatus 1, the printer control unit 41 sends an instruction to the motor driver 46, the exposure control unit 48, and the power source control unit 49, so that the patch pattern with the high density band shown in FIG. 3 is printed on the transfer belt 11 for the toner density correction. The patch pattern is printed in an order of black (K), yellow (Y), magenta (M), and cyan (C).

In step S2, the shutter 15 disposed between the transfer belt 11 and the density sensor 14 opens according to an instruction from the printer control unit 41, so that the density sensor 14 can read an image developed on the transfer belt 11. In step S3, the printer control unit 41 sends an instruction to the power source control unit 49 to drive the transfer belt 11, so that the patch pattern printed on the transfer belt 11 is situated above the density sensor 14 disposed under the transfer belt 11.

In step S4, the printer control unit 41 sends an instruction to the density sensor 14, so that the light emitting portion of the density sensor 14 irradiates measurement light on the patch pattern printed on the transfer belt 11. After the light receiving portion of the density sensor 14 receives light reflected from the patch pattern, the density of the toner 26 is measured according to an amount of light thus received. The density of the toner 26 is temporarily stored in the RAM 44 or the rewritable non-volatile memory. Note that the density of the toner 26 is measured in the order of black (K), yellow (Y), magenta (M), and cyan (C), and is sequentially stored in the RAM 44. The density of the toner 26 is measured within the distance L2 and the distance L3 once per each color. It may be configured such that the density of the toner 26 is measured a plurality of times, and an average of measurement values is stored in the RAM 44.

In step S5, the printer control unit 41 determines whether the density of the toner 26 is measured for all of black (K), yellow (Y), magenta (M), and cyan (C). When it is determined that the density of the toner 26 is not measured for all colors, the process returns to step S4, thereby measuring and storing the density of the toner 26 one more time. When it is determined that the density of the toner 26 is measured for all colors, the process proceeds to step S6. In step S6, the shutter 15 is closed.

In the next step, the printer control unit 41 calculates a density difference Δ between the density C2 and the density C3 stored in the RAM 44. Note that the measurement is performed with a similar process for all of black (K), yellow (Y), magenta (M), and cyan (C). In the following description, a case of cyan (C) will be explained.

In step S7, the printer control unit 41 retrieves the density C2 of the patch pattern in the distance L2 measured with the density sensor 14 and stored in the RAM 44, and the density C3 of the patch pattern in the distance L3 measured with the density sensor 14 and stored in the RAM 44. Then, the printer control unit 41 calculates the density difference A between the density C2 and the density C3, and stores the density difference Δ in the RAM 44.

In step S8, the printer control unit 41 refers to the supplying bias correction table corresponding to the density difference Δ stored in the ROM 45 in advance, and determines a correction value of the supplying bias according to the density difference Δ of the toner 26. The correction value of the supplying bias may be an appropriate value obtained from an experiment, or obtained from a theory according to a property of the developing roller 29 and the toner supplying roller 27.

An example of the supplying bias correction table is shown as Table.

TABLE

| Density difference | Supplying bias correction value (−V) |
|---|---|
| 0 | 0 |
| 0.1 | 15 |

TABLE-continued

| Density difference | Supplying bias correction value (−V) |
|---|---|
| 0.2 | 30 |
| 0.3 | 45 |
| 0.4 | 60 |
| 0.5 | 75 |
| 0.6 | 90 |
| greater than 0.7 | 105 |

As shown in Table, when the density difference Δ is 0.3, for example, the correction value of the supplying bias is −45 V. Accordingly, the bias voltage applied from the supplying bias power source 28 to the toner supplying roller 27 decreases by 45 V. Accordingly, for example, when an initial value of the supplying bias is −300 V, and the density difference Δ is 0.3, the supplying bias thus corrected becomes −345 V.

When the bias voltage decreases, an absolute value of a voltage difference between the developing roller 29 and the toner supplying roller 27 increases, so that an amount of the toner 26 supplied from the toner supplying roller 27 to the developing roller 29 increases. When an amount of the toner 26 supplied from the toner supplying roller 27 to the photosensitive drum 22 through the developing roller 29 increases, it is possible to supply a sufficient amount of the toner 26 to the photosensitive drum 22 even when an image with a high density is printed.

In step S9, the printer control unit 41 sends an instruction to the power source control unit 49 to change the bias voltage applied from the supplying bias power source 28 to the toner supplying roller 27 according to the correction value of the supplying bias, thereby correcting the density of the toner 26 developed on the density sensor 14.

More specifically, the toner 26 is supplied to the photosensitive drum 22 through the toner supplying roller 27 and the developing roller 29 provided with the developing blade 31. Accordingly, the voltage applied from the supplying bias power source 28 to the toner supplying roller 27 is adjusted to control an amount of the toner 26 supplied to the developing roller 29, thereby supplying a constant amount of the toner 26 to the photosensitive drum 22.

In the process described above, the density of the toner 26 is measured within the distance L2 and the distance L3 once per each color. Then, the printer control unit 41 calculates the density difference Δ between the density C2 and the density C3 stored in the RAM 44. Alternatively, the density of the toner 26 may be measured within the distance L1 as well (the density C1 in the case of cyan). In this case, the printer control unit 41 may calculate a density difference Δ between the density C1 and the density C3 or a density difference Δ between the density C1 and the density C2.

Further, in the process described above, when the density difference Δ is 0.3, for example, the correction value of the supplying bias is −45 V. Accordingly, the bias voltage applied from the supplying bias power source 28 to the toner supplying roller 27 decreases by 45 V. In this case, the supplying bias power source 28 may be adopted to apply the bias voltage to the toner supplying roller 27 during the photosensitive drum 22 contacts the area within the distance L2 according to the density difference Δ between the density C2 and the density C3. Further, the supplying bias power source 28 may be adopted to apply the bias voltage to the toner supplying roller 27 during the photosensitive drum 22 contacts the area within the distance L1 according to the density difference Δ between the density C1 and the density C3.

Further, the supplying bias power source 28 may be adopted to apply a normal bias voltage to the toner supplying roller 27 during the photosensitive drum 22 contacts an area within a length except the distance L1 and the distance L2. Alternatively, the supplying bias power source 28 may be adopted to apply a normal bias voltage (for example, −300 V) to the toner supplying roller 27 during the photosensitive drum 22 contacts the area within the length L1 and the distance L2. When the density difference Δ between the density C2 and the density C3 is 0.30, the supplying bias power source 28 applies the bias voltage thus corrected (for example, −345 V) to the toner supplying roller 27 during the photosensitive drum 22 contacts the area within the length L3.

Further, in the process described above, the printer control unit 41 refers to the supplying bias correction table corresponding to the density difference a stored in the ROM 45 in advance, and determines the correction value of the supplying bias according to the density difference Δ of the toner 26. Alternatively, the printer control unit 41 may refer to a developing blade bias correction table corresponding to the density difference Δ stored in the ROM 45 in advance, and determines a correction value of the developing blade bias according to the density difference Δ of the toner 26.

In the embodiment, when the image forming apparatus 1 is turned on, the density correction is performed. Alternatively, it may be configured such that the operator can select that the density correction is performed only when the image forming apparatus 1 is switched to the high quality printing operation required for high image quality and is not performed in a normal printing operation. Accordingly, it is possible to conserve the toner 26 according to image quality requested by the operator.

As described above, in the embodiment, the test image having a high density, i.e., a toner density of, for example, 100% is printed on the transfer belt 11 when the image forming apparatus 1 is turned on and initialized before the recording medium 4 is printed. Afterward, the density sensor 14 measures the density of the test image thus printed, and the voltage applied to the toner supplying roller 27 is adjusted such that the difference between the measured density and the standard density is canceled out. Accordingly, it is possible to prevent a density step from forming in the image printed on the recording medium 4, thereby preventing a blurred image or an afterimage generated in the image developed on the recording medium 4.

Second Embodiment

A second embodiment of the present invention will be explained next. In the second embodiment, as compared with the image forming apparatus 1 in the first embodiment, an image forming apparatus 51 calculates an image density of print data before an image is printed, and prints the test image on the transfer belt 11 only when the image density of the recording medium 4 exceeds a threshold value. Other components of the image forming apparatus 51 are similar to those in the image forming apparatus 1.

More specifically, in the second embodiment, the image forming apparatus 51 includes an image signal processing unit 52; a dot counter 53; and a print density calculation unit 54. With the configuration described above, it is possible to calculate an image density of print data before an image is printed, and performs the density correction of the toner image only when the image density of the recording medium 4 exceeds a threshold value. Explanations of the other components of the image forming apparatus 51 similar to those in the image forming apparatus 1 are omitted, and only different components will be explained.

Figure 7:
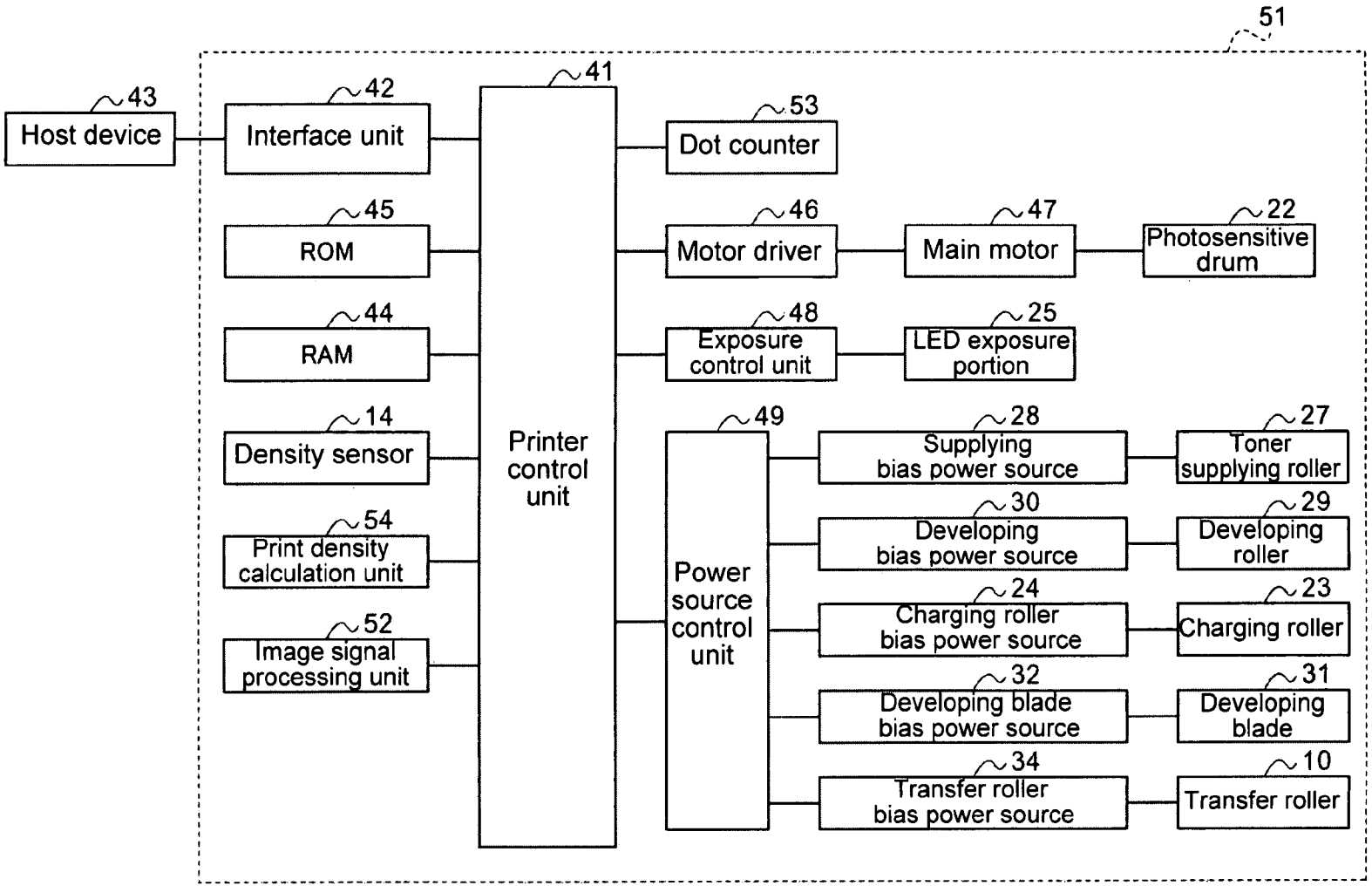
FIG. 7 is a block diagram showing a configuration of an image forming apparatus according to a second embodiment of the present invention.

A control system of the image forming apparatus 51 will be explained next. FIG. 7 is a block diagram showing a configuration of the image forming apparatus 51 according to the second embodiment of the present invention. As shown in FIG. 7, the image forming apparatus 51 is provided with the printer control unit 41 for controlling a process of developing the image information on the recording medium 4.

In the second embodiment, similar to that in the first embodiment, the printer control unit 41 is connected to the host device 43; the interface unit 42; the density sensor 14; the RAM 44; the ROM 45; the main motor 47; the motor driver 46; the exposure control unit 48; and the power source control unit 49. Further, the printer control unit 41 is connected to the image signal processing unit 52; the dot counter 53; and the print density calculation unit 54. In the following description, the image signal processing unit 52, the dot counter 53, and the print density calculation unit 54 will be explained in more detail.

In the embodiment, the image signal processing unit 52 is provided for performing a process of converting the image data to be printed on the recording medium 4 to dot data according to an instruction from the printer control unit 41. The dot counter 53 is provided for measuring a dot number of the image data corresponding to, for example, one page of the recording medium 4 after the image signal processing unit 52 converts the image data to be printed on the recording medium 4 to the dot data. The dot number thus measured is stored in the RAM 44.

In the embodiment, the print density calculation unit 54 is a print image density calculation unit for calculating an image density of an image to be printed on the recording medium 4. More specifically, the print density calculation unit 54 retrieves the dot number of the image data corresponding to one page of the recording medium 4 from the RAM 44. Then, the print density calculation unit 54 divides the dot number of the image data thus retrieved by a total dot number in a case that a whole surface of one page of the recording medium 4 is printed, thereby calculating the image density. Afterward, the print density calculation unit 54 sends a calculation result to the printer control unit 41.

Figure 8:
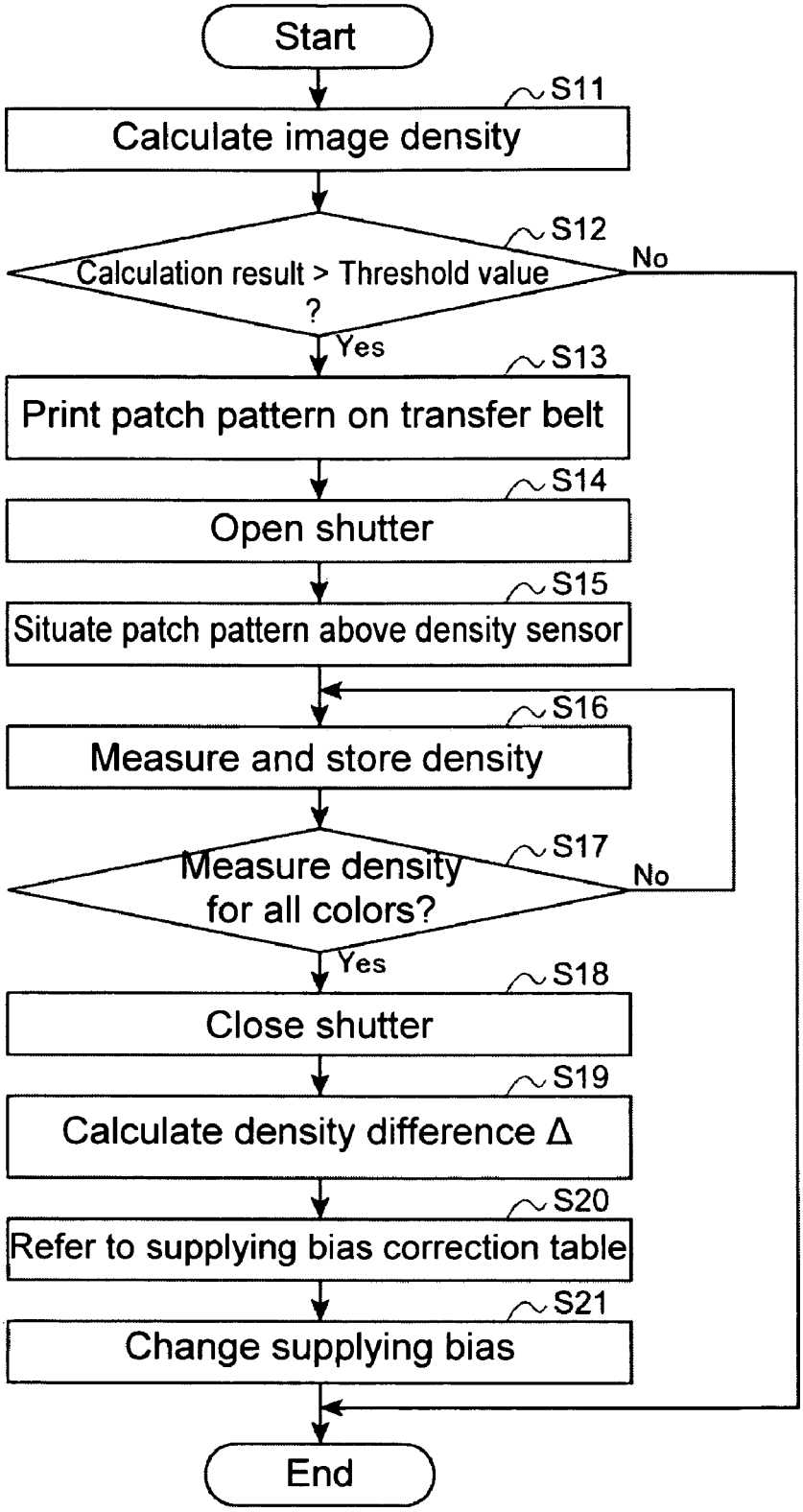
FIG. 8 is a flow chart showing an operation of the image forming apparatus for preventing a density step from forming in an image according to the second embodiment of the present invention.

An operation of the image forming apparatus 51 associated with the toner density correction for preventing a density step from forming in an image developed on the recording medium 4 will be explained next. FIG. 8 is a flow chart showing the operation of the image forming apparatus 51 associated with the toner density correction for preventing a density step from forming in an image according to the second embodiment of the present invention.

Before the printing operation starts, the printer control unit 41 receives the print data from the host device 43 through the interface unit 42, and the printer control unit 41 sends the print data to the image signal processing unit 52. Then, the image signal processing unit 52 converts the image data to the dot data. In the next step, the dot counter 53 measures the dot number of the image data corresponding to one page of the recording medium 4 after the image signal processing unit 52 converts the image data to the dot data. The dot number thus measured is stored in the RAM 44.

In step S11, according to an instruction from the printer control unit 41, the print density calculation unit 54 retrieves the dot number of the image data corresponding to one page of the recording medium 4 from the RAM 44. Then, the print density calculation unit 54 calculates the image density, and sends the calculation result to the printer control unit 41.

In step S12, the printer control unit 41 determines whether the calculation result is greater than a threshold value. When it is determined that the calculation result is greater than the threshold value, the process proceeds to step S13. When it is determined that the calculation result is less than the threshold value, the process is completed. It is preferred that the threshold value is set to 80%, and may be properly set according to a characteristic and an installation environment of the image forming apparatus 51.

The process from step S13 to step S21 is similar to that from step S1 to S9 of the process of the toner density correction in the first embodiment shown in FIG. 5, and an explanation thereof is omitted.

As described above, in the second embodiment, before the printing operation is performed, the image density of the print data is calculated. Only when the image density is greater than the threshold value, the test image with the high density, i.e., 80%, is printed on the transfer belt 11. Afterward, the density sensor 14 measures the density of the test image thus printed, and the voltage applied to the toner supplying roller 27 is adjusted such that the difference between the measured density and the standard density is canceled out, thereby correcting an amount of the toner 26 supplied from the toner supplying roller 27 to the developing roller 29. Accordingly, it is possible to prevent a density step from forming in the image printed on the recording medium 4, thereby preventing a blurred image or an afterimage generated in the image developed on the recording medium 4. Further, it is possible to reduce consumption of the toner 26, and reduce a time for initializing the image forming apparatus 51.

In the first and second embodiments, the image forming apparatus 1 and the image forming apparatus 51 are explained as the printing apparatus, and may be provided in a copier, a facsimile, a multi-function product, and the likes.

The disclosure of Japanese Patent Application No. 2008-142047, filed on May 30, 2008, is incorporated in the application by reference.

While the invention has been explained with reference to the specific embodiments of the invention, the explanation is illustrative and the invention is limited only by the appended claims.

What is claimed is:

1. An image forming apparatus, comprising:

an image supporting member for forming a developer image in a specific patch pattern, said specific patch pattern including a first portion having a first length, a second portion having a second length, and a third portion having a third length, said specific patch pattern having a fourth length equal to a sum of the first length, the second length, and the third length;

a developing unit for forming a developer layer and forming the developer image on the image supporting member using developer of the developer layer, said developing unit having a circumferential length equal to the first length;

a developer supplying unit for supplying the developer to the developing unit, said developer supplying unit having a circumferential length greater than the second length;

an image density detection unit for detecting an image density difference between an image density of the developer image in the second portion and an image density of the developer image in the third portion; and a control unit for controlling a voltage applied to the developing unit and the developer supplying unit, said control unit correcting the voltage applied to at least one of the developing unit and the developer supplying unit according to the image density difference detected with the image density detection unit.

2. The image forming apparatus according to claim 1, further comprising a developing power source for applying a developing voltage to the developing unit and a developer supplying power source for applying a developer supplying voltage to the developer supplying unit, said control unit controlling the developing power source and the developer supplying power source.

3. The image forming apparatus according to claim 1, wherein said control unit is adopted to calculate a difference between the voltage applied to the developing unit and the voltage applied to the developer supplying unit.

4. The image forming apparatus according to claim 1, further comprising a print image density calculation unit for calculating the image density of the developer image, said control unit being adopted to correct the voltage applied to at least one of the developing unit and the developer supplying unit when the image density exceeds a threshold value.

5. The image forming apparatus according to claim 4, wherein said print image density calculation unit is adopted to calculate the image density of the developer image according to a dot number of a dot image converted from print data.

6. The image forming apparatus according to claim 1, further comprising an image quality mode selection unit for selecting whether the control unit corrects the voltage so that an operator uses the image quality mode selection unit to select whether the control unit corrects the voltage.

7. The image forming apparatus according to claim 1, further comprising a transfer unit for transferring the developer image formed on the image supporting member, said image density detection unit detecting the image density of the developer image transferred from the image supporting member to the transfer unit.

8. The image forming apparatus according to claim 1, further comprising a blade member disposed in the developing unit for controlling a thickness of the developer layer.

9. The image forming apparatus according to claim 8, wherein said control unit is adopted to correct a voltage applied to the blade member according to the image density.

10. The image forming apparatus according to claim 1, wherein said image supporting member is arranged to form the developer image in the specific patch pattern having continuously the first portion, the second portion, and the third portion.

* * * * *